United States Patent [19]

Ertl et al.

[11] Patent Number: 4,485,565

[45] Date of Patent: Dec. 4, 1984

[54] DRYING ARRANGEMENT FOR PHOTOSENSITIVE ARTICLES

[75] Inventors: Franz Ertl, Munich; Adolf Fleck, Unterhaching; Nikolaus Jelinek, Munich, all of Fed. Rep. of Germany

[73] Assignee: Afga-Gevaert Aktiengesellschaft, Leverkusen, Fed. Rep. of Germany

[21] Appl. No.: 387,329

[22] Filed: Jun. 11, 1982

[30] Foreign Application Priority Data

Jun. 24, 1981 [DE] Fed. Rep. of Germany ..... 3124688

[51] Int. Cl.[3] ..... F26B 23/04

[52] U.S. Cl. ..... 34/4; 34/41; 250/504 R

[58] Field of Search ..... 15/256.52; 118/643, 118/117; 250/504, 494.1, 492.1, 319, 316.1; 219/354, 356, 358, 388, 405, 411; 34/4, 41, 236

[56] References Cited

U.S. PATENT DOCUMENTS

| | | | |
|---|---|---|---|
| 3,626,155 | 12/1971 | Joeckel | 219/358 |
| 3,703,156 | 11/1972 | Niesen et al. | 118/117 |
| 3,900,959 | 8/1975 | Breschi et al. | 34/41 |
| 4,117,604 | 10/1978 | Burg et al. | 118/117 |
| 4,169,007 | 9/1978 | Pray | 34/4 |

FOREIGN PATENT DOCUMENTS

| | | | |
|---|---|---|---|
| 2323725 | 11/1973 | Fed. Rep. of Germany . | |
| 1581533 | 12/1980 | United Kingdom | 34/41 |

*Primary Examiner*—Larry I. Schwartz
*Attorney, Agent, or Firm*—Peter K. Kontler

[57] ABSTRACT

A drying arrangement for strips or sheets of photosensitive material includes a pair of infrared heating rods which are located on opposite sides and extend transversely of the path of travel of the photosensitive material. A parabolic reflector is associated with each of the heating rods and serves to direct radiant energy from the same onto the photosensitive material. The heating rods lie at the focal points of the respective parabolic reflectors. Each of the reflectors has a symmetry plane which is inclined with reference to the path of the photosensitive material in such a manner that the line of intersection of the symmetry plane and the path is situated downstream of the location where a perpendicular from the focal point of the reflector to the path intersects the latter. By virtue of this arrangement, more radiant energy is directed to the upstream portion of the drying arrangement than to the downstream portion thereof. As a result, a thermal gradient exists in the drying arrangement. This gradient corresponds to the degree of dryness of the photosensitive material. Thus, the radiant energy is most intense in that portion of the drying arrangement where the photosensitive material carries the most liquid and least intense in that portion of the drying arrangement where the photosensitive material is virtually dry.

32 Claims, 1 Drawing Figure

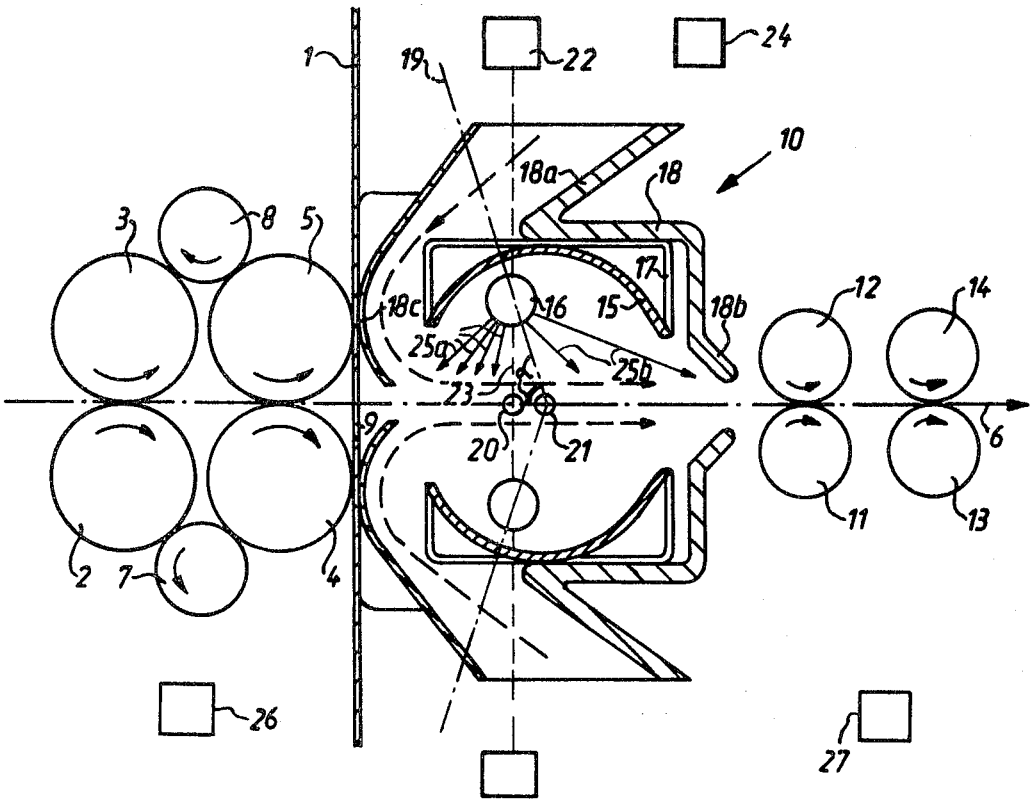
1
19
22
24
10
18a
18
3
8
5
17
18c
16
15
18b
12
14
25a
25b
23
9
20
21
6
11
13
2
7
4
26
27

DRYING ARRANGEMENT FOR PHOTOSENSITIVE ARTICLES

CROSS-REFERENCE TO RELATED APPLICATION

This application contains subject matter similar to that disclosed and claimed in the commonly-owned, copending application Ser. No. 387,328, of Franz ERTL et al. entitled "Drying Arrangement for Photosensitive Commodities" and filed June 11, 1982.

BACKGROUND OF THE INVENTION

The invention relates generally to a drying arrangement.

More particularly, the invention relates to an arrangement for drying strips or sheets of photosensitive material, e.g. film.

A known drying arrangement for strips or sheets of photosensitive material has drying cells arranged on opposite sides of the path of travel of the photosensitive material. The drying cells are located between pairs of transporting rollers. Each drying cell includes a parabolic reflector and a rod-like, radiant heating element located at the focal point of the parabolic reflector. The parabolic reflector directs the radiant energy from the heating element towards the path of travel of the photosensitive material. A blower is provided to direct air onto the photosensitive material.

An arrangement of the type outlined above is disclosed in the German Offenlegungsschrift No. 23 23 725. This arrangement is relatively expensive since three or four heat sources are required on either side of the photosensitive material in order to adequately dry the photosensitive material while protecting the same against damage, that is, in order to adequately dry the photosensitive material without heating the same excessively.

OBECTS AND SUMMARY OF THE INVENTION

It is an object of the invention to provide a relatively inexpensive drying arrangement which is particularly well-suited for drying sheets and strips of photosensitive material such as film.

Another object of the invention is to provide a relatively simple drying arrangement which is particularly well-suited for drying sheets and strips of photosensitive material such as film.

An additional object of the invention is to improve an arrangement of the type outlined above so that adequate and uniform drying may be achieved with lower capital outlays.

The preceding objects, as well as others which will become apparent as the description proceeds, are achieved by the invention.

One aspect of the invention resides in a drying arrangement, particularly for strips and sheets of photosensitive material, which comprises means defining a predetermined path for an article to be dried. The path includes a drying zone having an upstream portion and a downstream portion. Means is provided for drying the article in the heating zone and includes a radiant heating element as well as a reflector for directing radiant energy from the heating element towards the path of the article. The reflector is arranged so that the amount of radiant energy directed towards the upstream portion of the heating zone exceeds the amount directed towards the downstream portion thereof.

By means of the invention, drying occurs in a heat gradient. At the beginning of the drying operation when a relatively thick layer of fluid, e.g. water, adheres to the article, a larger amount of radiant energy is directed onto the article than subsequently when the article has traveled a certain distance through the drying zone and is almost dry. In this manner, the invention makes it possible to adequately dry an article using only a single heat source on either side thereof.

According to a preferred embodiment of the invention, the reflector is parabolic and has a symmetry plane and the heating element is rod-like and is located at the focal point of the reflector. The reflector is positioned in such a manner that the intersection of the path of the article with a perpendicular from the focal point lies upstream of the intersection between the path and the symmetry plane. The positioning of the reflector so as to obtain this geometry makes it possible to achieve the result mentioned above, that is, makes it possible to adequately dry an article using only a single heat source on either side of the article.

The novel features which are considered as characteristic of the invention are set forth in particular in the appended claims. The improved drying arrangement itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a schematic sectional elevational view of a drying arrangement in accordance with the invention.

DESCRIPTION OF THE PREFERRED EMBODIMENTS

The drying arrangement of the FIGURE is assumed to constitute part of a developing apparatus for film. The reference numeral 1 identifies a dividing wall between the wet region and the dry region of the devloping apparatus. The wet region is located to the left of the dividing wall 1 while the dry region is located to the right of the dividing wall 1.

The discharge end of the wet region is located adjacent to the dividing wall 1. Two pairs of cooperating conveying rollers 2,3 and 4,5 are located at the discharge end of the wet region and are driven in the directions indicated by the respective arrows via a drive 26. The rollers 2–5 serve to transport a sheet or strip of film in a direction from the wet region towards the dry region of the developing apparatus along a path 6.

A distributing roller 7 is located adjacent to the lower rollers 2 and 4 of the set of conveying rollers 2–5 while a distributing roller 8 is located adjacent to the upper rollers 3 and 5 of the set of conveying rollers 2–5. The distributing roller 7 is disposed on that side of the lower rollers 2 and 4 remote from the path 6 while the distributing roller 8 is similarly disposed on that side of the upper rollers 3 and 5 remote from the path 6. The distributing roller 7 is in contact with the lower rollers 2 and 4 whereas the distributing roller 8 is in contact with the upper rollers 3 and 5. As will be explained again below, the function of the distributing rollers 7 and 8 is to uniformly distribute any liquid adhering to the conveying rollers 2–5 over the same. The distributing rollers 7 and 8 need not be driven and may rotate in the directions indicated by the respective arrows simply by virtue of their contact with the conveying rollers 2–5.

The dividing wall 1 is provided with an opening 9 through which the film may be transported from the wet into the dry region of the developing apparatus.

The dry region of the developing apparatus includes a drying zone or cell 10. A film transported through the drying zone 10 along the path 6 is dried on both sides during its passage through the drying zone 10. Two pairs of cooperating conveying rollers 11,12 and 13,14 are arranged immediately downstream of the discharge end of the drying zone 10 and assist the conveying rollers 2–5 in transporting a sheet or strip of film along the path 6. The conveying rollers 11–14 are driven in the directions indicated by the respective arrows via a drive 27.

The drying zone 10 is symmetrical about the path 6 of the film. Accordingly, only the portion of the drying zone 10 above the path 6 will be described and it will be understood that the portion of the drying zone 10 below the path 6 is identical.

The drying zone 10 includes an infrared heating rod 16 which extends transversely of the path 6. The heating rod 16 lies at the focal point of a cylindrical, parabolic reflector or mirror 15. The reflector 15 and heating rod 16 are located inside a housing 18. The reflector 15 is mounted on a support or frame 17 which, in turn, is secured to the housing 18. The heating rod 16 is mounted in the housing 18 in a conventional, non-illustrated manner.

The housing 18 has an air inlet section 18*a* via which fresh air may be forced into the housing 18 by means of a blower 24 or the like. The air inlet section 18*a* is located behind the reflector 15 as considered in the direction of air flow. The housing 18 is further provided with a guide section or flange 18*b* which extends toward the path 6 and the pair of conveying rollers 11,12 and is inclined with reference to the path 6. The housing 18 also has a deflecting wall 18*c*. As indicated by the dashed arrows, the deflecting wall 18*c* directs the air entering the housing 18 between the path 6 and the heating rod 16 or reflector 15. The deflecting wall 18*c* causes the air which enters the housing 18 to flow tangentially to the path 6 in downstream direction thereof.

The reflector 15 has a symmetry plane 19 which, in accordance with the invention, is inclined with reference to the path 6. The symmetry plane 19 is inclined in such a manner that the point 20 at which a perpendicular 23 from the focal point of the reflector 15 intersects the path 6 is located upstream of the line of intersection 21 between the symmetry plane 19 and the path 6. In other words, the intersection 20 of the perpendicular 23 and path 6 is situated nearer the inlet end of the drying zone 10 than the intersection 21 of the symmetry plane 19 and the path 6. It will be observed that the portion of the reflector 15 to the left of the symmetry plane 19 is shorter than the portion of the reflector 15 to the right of the symmetry plane 19. Stated differently, the portion of the reflector 15 on the side of the symmetry plane 19 remote from the inlet end of the drying zone 10 is longer than the portion of the reflector 15 on the side of the symmetry plane 19 which faces the inlet end of the drying zone 10.

The angle alpha between the symmetry plane 19 and the path 6 preferably lies in the range of about 60 to 80 degrees. It is particularly advantageous for the angle alpha to be in the range of about 70 to 75 degrees.

The preceding arrangement of the reflector 15 enables the radiant energy from the heating rod 16 to be spread over a large area during operation. Furthermore, this arrangement of the reflector 15 results in a heat or temperature gradient along the drying zone 10 in downstream direction of the path 6. The gradient is such that the amount of radiant energy directed towards the upstream region of the drying zone 10 exceeds the amount of radiant energy directed towards the downstream region of the drying zone 10. This is schematically illustrated by the relatively closely spaced arrows 25*a* directed towards the upstream region of the drying zone 10 and the more widely spaced arrows 25*b* directed towards the downstream region of the drying zone 10. Due to the heat or temperature gradient achieved by the arrangement of the reflector 15 according to the invention, the intensity of the radiation along the drying zone 10 may vary in dependence upon the thickness of the liquid layer on the film. Thus, the intensity of the radiation may diminish in downstream direction of the drying zone 10 in correspondence to the decrease in the thickness of the liquid layer on the film.

Another advantage of the arrangement of the reflector 15 in accordance with the invention resides in that the total output of the heating rod 16 may be made lower than the outputs used heretofore. This makes it possible to limit heating of the structural elements constituting part of the dry region of the developing apparatus and surrounding the heating rod 16 so that such elements are heated only slightly.

As mentioned earlier, fresh air is forced into the drying zone 10 by the blower 24 via the air inlet section 18*a* of the housing 18. Such air may be at room temperature. The air traveling through the air inlet section 18*a* is directed into the drying zone 10 by the curved deflecting wall 18*c*. The air caused to flow through the drying zone 10 in this manner conveys the vapor, e.g. water vapor, generated during drying out of the drying zone 10. As also indicated previously, the air travels through the drying zone 10 in downstream direction of the path 6 of the film, that is, concurrently with the film, in contrast to conventional drying arrangements where the air flows turbulently. The flow of air in accordance with the invention has the result that the conveying rollers 2–5 upstream of the drying zone 10 are not significantly heated. Hence, detrimental uncontrolled drying of the film by the conveying rollers 2–5 prior to entry of the film into the drying zone 10 is avoided. Moreover, air admitted into the drying zone 10 in accordance with the invention enters the drying zone 10 in the region of the most intense radiation and prevents overheating of the film in this region. The opening defined at the discharge end of the drying zone 10 by the guide section 18*b* is made sufficiently large to achieve laminar flow of the air.

The conveying rollers 2–5 cooperate with the distributing rollers 7 and 8 to uniformly distribute the liquid, e.g. water, adhering to the film over the same. The distributing rollers 7 and 8 press lightly against the associated ones of the conveying rollers 2–5 and function to uniformly distribute liquid carried along by the rollers 2–5 over the latter. The conveying rollers 2–5, in turn, transfer the distributed liquid to the film in a uniform fashion. The film which has been pretreated in this manner is subsequently uniformly dried in the drying zone 10. Stains which occur when certain areas dry more slowly than others are avoided.

The heating rod 16 may be connected with a pulse generator 22 which enables the heating rod 16 to be periodically activated and deactivated. For instance, it may be desired to operate in such a manner that current is supplied to the heating rod 16 only 50% of the time. The pulse generator 22 would then alternately activate and deactivate the heating rod 16 for equal lengths of time. By way of example, each period of activation and deactivation might be equal to one-tenth of a second or one-half of a second. Reliable switching of the heating rod 16 may be obtained by appropriate computer control of the pulse generator 22 which insures that the heating rod 16 is switched on and off at specific intervals, e.g. at the crossover points of the phases.

The pulse generator 22 may be designed to permit the power output of the heating rod 16 to be varied. This has the advantage that the radiant energy emitted by the heating rod 16 may be adjusted to the absorption characteristics of the film. Thus, the thickness of the liquid layer which forms on a film is different for different types of film. By designing the pulse generator 22 so as to permit the power output of the heating rod 16 to be varied, the wavelength of the radiant energy may be adjusted to the thickness of the liquid layer. In other words, the wavelength of the radiant energy may be decreased as the thickness of the liquid layer increases and vice versa. This makes it possible to supply only so much energy to the film as is required for evaporation of the liquid layer. Consequently, excessive heating of the film may be avoided.

It will be understood that variations in the power output of the heating rod 16 may also be achieved using a transformer or phase controller.

By way of example, the arrangement according to the invention is capable of drying an x-ray film moving at a speed of forty centimeters per minute within a stretch of four centimeters when the heating rod 16 is operated at a power output of 200 to 400 watts and the blower 24 is operated at an output of approximately 200 cubic meters per hour.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. drying arrangement, particularly for strips and sheets of photosensitive material, comprising:

(a) means defining a predetermined path for an article to be dried, said path including a drying zone having an upstream portion and a downstream portion; and (b) means for drying the article in said zone, said drying means including a radiant heating element, and a reflector for directing radiant energy from said element towards said path, and said reflector being designed to diffuse the radiant energy over the length and width of said zone in such a manner that the amount of radiant energy directed towards said path decreases from said upstream portion towards said downstream portion.

2. An arrangement as defined in claim 1, said reflector having a focal point and a symmetry plane; and wherein said reflector is positioned such that a perpendicular from said focal point to said path intersects the latter at a first location while said symmetry plane intersects said path at a second location downstream of said first location.

3. An arrangement as defined in claim 2, wherein said element lies at said focal point.

4. An arrangement as defined in claim 1, wherein said defining means comprises conveying means for conveying the article through said zone.

5. An arrangement as defined in claim 1, comprising means for removing evaporated fluid from said zone.

6. An arrangement as defined in claim 1, comprising control means for varying the output of said element and thereby the wavelength of the radiant energy emitted therefrom.

7. An arrangement as defined in claim 1, wherein said drying means comprises a first drying unit including said element and said reflector, and a second drying unit including an additional radiant heating element, and an additional reflector for directing radiant energy from said additional element towards said path, said first and second units being substantially symmetrically disposed on opposite sides of said path.

8. An arrangement as defined in claim 3, wherein said reflector is parabolic.

9. An arrangement as defined in claim 2, said element being located at one side of said path; and further comprising an additional radiant heating element at the other side of said path, and an additional reflector for directing radiant energy from said additional element towards said path, said additional reflector having an additional focal point and an additional symmetry plane, and said additional reflector being positioned such that a perpendicular from said additional focal point to said path intersects the latter at one location while said additional symmetry plane intersects said path at another location downstream of said one location.

10. An arrangement as defined in claim 9, wherein said one location is substantially coextensive with said first location and said other location is substantially coextensive with said second location.

11. An arrangement as defined in claim 9, wherein said additional element lies at said additional focal point.

12. An arrangement as defined in claim 11, wherein said additional reflector is parabolic.

13. An arrangement as defined in claim 2, wherein said symmetry plane intersects said path along a line which is situated downstream of said first location in its entirety.

14. An arrangement as defined in claim 2, wherein said symmetry plane and said path intersect at an angle in the range of about 60° to 80°.

15. An arrangement as defined in claim 14, wherein said angle is in the range of about 70° to 75°.

16. An arrangement as defined in claim 1, wherein said element is rod-like.

17. An arrangement as defined in claim 1, wherein said reflector is arcuate.

18. An arrangement as defined in claim 4, wherein said conveying means comprises a cooperating first pair of conveying rollers upstream of said zone and a cooperating second pair of conveying rollers downstream of said zone.

19. An arrangement as defined in claim 18, comprising a pair of distributing rollers which respectively contact the conveying rollers of said first pair of distribute fluid adhering to such rollers over the same.

20. An arrangement as defined in claim 19, comprising a cooperating additional pair of conveying rollers upstream of said zone; and wherein said distributing rollers respectively contact the conveying rollers of said additional pair.

21. An arrangement as defined in claim 18, wherein said path is substantially horizontal and the conveying rollers of the respective pairs are arranged one above the other.

22. An arrangement as defined in claim 5, wherein said removing means comprising a blower for conveying a stream of air through said zone.

23. An arrangement as defined in claim 22, comprising directing means for directing a stream of air in said zone along a flow path which substantially parallels said predetermined path.

24. An arrangement as defined in claim 23, wherein said flow path is substantially tangential to said predetermined path.

25. An arrangement as defined in claim 23, wherein said directing means causes a stream of air in said zone to travel in the downstream direction of said predetermined path.

26. An arrangement as defined in claim 6, wherein said control means is operative to periodically activate and deactivate said element.

27. An arrangement as defined in claim 1, comprising conveying means for conveying a stream of air through said zone, and directing means for directing the stream along a flow path which substantially parallels said predetermined path, said directing means being arranged so that the stream enters said zone in the region of said upstream portion and travels towards said downstream portion.

28. An arrangement as defined in claim 27, wherein said directing means comprises a curved wall for deflecting the air entering said zone so that the air stream is caused to parallel said predetermined path, said wall cooperating with said reflector to define a flow passage for the air travelling towards said zone.

29. A drying arrangement for sheets and strips of photosensitive material comprising:

(a) means defining a predetermined path for an article to be dried, said path including a drying zone having an upstream portion and a downstream portion; and (b) means for drying the article in said zone, said drying means including a first drying unit having a first radiant heating element, and a first parabolic reflector for directing radiant energy from said first element towards said path, and said drying means further including a second drying unit having a second radiant heating element, and a second parabolic reflector for directing radiant energy from said second element towards said path, said first and second units being substantially symmetrically disposed on opposite sides of said path, and each of said reflectors being designed to diffuse the radiant energy from the respective element over the length and width of said zone in such a manner that the amount of radiant energy directed towards said path decreases from said upstream portion towards said downstream portion.

30. An arrangement as defined in claim 29, each of said reflectors having a focal point and a symmetry plane, and each of said elements lying at the respective focal point; and wherein said reflectors are positioned such that the perpendiculars from said focal points to said path intersect the latter at a first location while the symmetry planes intersect said path at a second location downstream of said first location.

31. An arrangement as defined in claim 29, comprising conveying means for conveying a stream of air through said zone on either side of said path, and directing means for directing the streams along flow paths which substantially parallel said predetermined path, said directing means being arranged so that the streams enter said zone in the region of said upstream portion and travel towards said downstream portion.

32. An arrangement as defined in claim 31, wherein said directing means comprises a curved wall on either side of said predetermined path for deflecting air entering said zone so that the respective air stream is caused to parallel said predetermined path, each of said walls cooperating with the respective reflector to define a flow passage for the air travelling towards said zone.

* * * * *

UNITED STATES PATENT AND TRADEMARK OFFICE

CERTIFICATE OF CORRECTION

PATENT NO. : 4,485,565

DATED : December 4, 1984

INVENTOR(S) : Franz ERTL et al.

It is certified that error appears in the above-identified patent and that said Letters Patent are hereby corrected as shown below:

Foremost page [75] Inventors: after the second Munich, add --Rudolf LOISTL, Unterhaching; Ernst WIDEMANN, Dachau,--.
Column 5, line 54, after "1." insert --A--.
Column 7, line 3, after pair delete "of" and insert --to--.
Column 7, line 16, after means, change "comprising" to --comprises--.

Signed and Sealed this

*Thirtieth* Day of *April 1985*

[SEAL]

*Attest:*

DONALD J. QUIGG

*Attesting Officer* *Acting Commissioner of Patents and Trademarks*